US006752674B2

(12) United States Patent
Jolly

(10) Patent No.: US 6,752,674 B2
(45) Date of Patent: Jun. 22, 2004

(54) SPORTBOARD FIN ATTACHMENT SYSTEM

(75) Inventor: Barry A. Jolly, Burleigh Heads (AU)

(73) Assignee: Oam, LLC, Oceanside, CA (US)

( * ) Notice: Subject to any disclaimer, the term of this patent is extended or adjusted under 35 U.S.C. 154(b) by 78 days.

(21) Appl. No.: 10/155,287

(22) Filed: May 23, 2002

(65) Prior Publication Data

US 2003/0220030 A1 Nov. 27, 2003

(51) Int. Cl.[7] ..... B63B 35/79
(52) U.S. Cl. ..... 441/79; 114/140
(58) Field of Search ..... 441/74, 79; 114/140

(56) References Cited

U.S. PATENT DOCUMENTS

| | | | | | |
|---|---|---|---|---|---|
| 3,890,661 | A | * | 6/1975 | Johnson | 441/79 |
| 3,965,514 | A | | 6/1976 | Shafer et al. | 9/310 E |
| 4,379,703 | A | | 4/1983 | Mizell | 441/79 |
| 4,421,492 | A | | 12/1983 | Leva | 441/79 |
| 4,733,496 | A | | 3/1988 | Wallner | 441/79 |
| 4,804,347 | A | * | 2/1989 | Ross | 441/79 |
| 4,846,745 | A | | 7/1989 | Lobe | 441/79 |
| 5,176,096 | A | | 1/1993 | Molnar et al. | 114/127 |
| 5,176,553 | A | | 1/1993 | Tuttle | 441/79 |
| 5,215,488 | A | * | 6/1993 | Bailey | 441/79 |
| 5,356,324 | A | | 10/1994 | Cunningham | 441/79 |
| 5,480,331 | A | | 1/1996 | Lewis | 441/79 |
| 5,493,989 | A | | 2/1996 | Anderson | 114/138 |
| 5,567,190 | A | | 10/1996 | Oates | 441/79 |
| 5,672,081 | A | | 9/1997 | Whitty | 441/79 |
| 5,813,890 | A | | 9/1998 | Benham | 441/79 |
| 5,910,035 | A | | 6/1999 | Rebotier et al. | 441/74 |
| 5,934,962 | A | | 8/1999 | Daum et al. | 441/79 |
| 5,934,963 | A | | 8/1999 | Frizzell | 441/79 |
| 5,951,347 | A | | 9/1999 | Hudson et al. | 441/79 |
| 5,957,742 | A | | 9/1999 | Brennan | 441/79 |
| 5,975,974 | A | | 11/1999 | McCausland | 441/79 |
| 5,997,376 | A | | 12/1999 | Block et al. | 441/79 |
| 6,053,789 | A | | 4/2000 | Miyashiro | 441/79 |
| 6,082,154 | A | | 7/2000 | MacDonald | 70/18 |
| 6,106,346 | A | | 8/2000 | Bolen | 441/79 |
| 6,139,383 | A | | 10/2000 | Jolly et al. | 441/74 |
| D437,907 | S | | 2/2001 | Stuart et al. | D21/778 |
| 6,213,044 | B1 | | 4/2001 | Rodgers et al. | 114/152 |
| 6,244,921 | B1 | | 6/2001 | Pope | 441/79 |
| 6,247,985 | B1 | | 6/2001 | Block et al. | 441/79 |
| 6,386,933 | B1 | | 5/2002 | Rewald | |

FOREIGN PATENT DOCUMENTS

| | | | |
|---|---|---|---|
| DE | 3206057 | Al | 9/1983 |
| WO | WO 01/70565 | Al | 9/2001 |
| WO | WO 02/47971 | Al | 6/2002 |

* cited by examiner

*Primary Examiner*—Ed Swinehart
(74) *Attorney, Agent, or Firm*—Kenneth J. Hovet

(57) ABSTRACT

A sportboard fin attachment assembly in accordance with the present invention includes a plug that is inserted into the cavity of a socket to define an enclosure. The enclosure is embedded into the underside of a sportboard so that the top wall of the enclosure is co-planar with the sportboard underside. The enclosure includes a tag slot that extends through the top wall into communication with the cavity. The plug has a clamp that forms a pin slot that is oriented perpendicular to the tag slot and is in communication with the cavity. The assembly also includes a fin and a tag that is releasably attached to the base of the fin. Alternate tags having beveled top surfaces are available for attachment to the fin. The beveled surfaces will cause the fin to be inclined at predetermined angles. A tag pin extends outwardly from a tag sidewall. When the tag is moved through the tag slot into the cavity, the tag pin will enter the pin slot. Once the pin is in the pin slot, the tag and attached fin, can be moved longitudinally to a selected position. Thereafter, a grub screw in the top wall is used to apply a force to the clamp and cause the pin to be constrained within the pin slot, thereby fixing the tag (and the attached fin) to the sportboard.

35 Claims, 6 Drawing Sheets

SPORTBOARD FIN ATTACHMENT SYSTEM

BACKGROUND OF THE INVENTION

1. Field of Invention

The present invention pertains generally to a device and method for adjustably attaching fins to a sportboard. The invention is particularly, but not exclusively, useful for attaching fins in a manner that allows for quick and convenient adjustment of the position of a fin on a sportboard to maximize the sportboard performance.

2. Description of Related Art

Sportboards, such as surfboard and sailboards, are well known in the prior art for providing recreational enjoyment. Typically, between one to four fins are attached to the underside of the board for facilitating stability and maneuverability. The fins have often been permanently mounted to the underside of the board.

However, there are several disadvantages to permanently mounting a fin to a board. Specifically, the fin cannot be easily removed and replaced if it becomes damaged. Further, the fin cannot be replaced with another fin having different performance properties. This would be advantageous if the user wishes to experiment with different fin configurations according to prevailing wind and surf conditions. Still further, a permanently mounted fin makes the surfboard unwieldy and difficult to transport. For the above reasons, it would be desirable to have fins that can be detachably mounted to the surfboard.

In addition to being detachable, it would be helpful to be able to adjust the position of a fin relative to the board when it is attached. In particular, to maximize the effectiveness of a fin for a variety of wind and surf conditions, it is important to be able to change the longitudinal position of the fin on the board. It is also desirable to be able to change the fin roll angle, i.e., the angle the fin makes with respect to the underside of the board. Additionally, it is important to be able to adjust the fin by hand or with a small tool which would fit within a swimming suit or a wetsuit pocket without causing any discomfort to the wearer.

U.S. Pat. No. 6,139,383, which issued to Barry A. Jolly et al for an invention entitled "Fin Assembly", discloses a fin attachment system wherein a mounting device having a front socket and a rear socket is embedded within a surfboard. A fin having predetermined projections are respectively inserted into the front socket and rear socket and fixed thereto by set screws. For the device as disclosed by Jolly et al, however, there is no tag slot or pin slot in the socket mounting to permit longitudinal movement or adjustment of the fin roll angle.

U.S. Pat. No. 5,997,376, which issued to Block et al for an invention entitled "Surfboard Fin Mounting System", discloses a fin that is adjustably attached to a box which is embedded within the surfboard. (The box is mounted in an opening cut into the surfboard.) The box includes a tag slot, but not a pin slot, and the fin is detachably fixed to the surfboard by passing a fastener through the top of the surfboard and threading the fastener into the fin. For the device disclosed by Block et al, however, the fin and tag lack versatility because they are a single integral unit. Further, the tag interfits within the tag slot in a manner which allows for longitudinal adjustment only. Additionally, it is undesirable to place an unsightly opening in the surfboard for installing a contrasting box which visibly extends through the surfboard.

U.S. Pat. No. 5,672,081, which issued to Whitty for an invention entitled "Surf Fin Fixing System", discloses a detachable fin wherein two spaced-apart tabs extend downwardly from the fin. The tabs are inserted into slots within a fixing element which is embedded in the surfboard and fixed thereto by a set screw which is obliquely inserted into the fixing element until it contacts a tab. However, Whitty does not envision any structure for adjusting the fin longitudinal position or fin roll angle. The main emphasis of Whitty is simply to provide a fin removal system.

SUMMARY OF THE INVENTION

In the light of the above, it is an object of the present invention to provide a sportboard fin attachment system that allows for quick and easy attachment and removal of the fin from the board. It is another object of the present invention to provide a sportboard fin attachment system that allows for adjustment of both longitudinal fin position and fin roll angle relative to the board. Yet another object of the present invention is to provide a sportboard fin attachment system wherein the user can adjust the longitudinal fin position and fin roll angle by hand or with a small implement which can be comfortably stowed in a swimsuit or wetsuit. Still another object of the present invention is to provide a sportboard fin attachment assembly which is easy to install on a sportboard and has significant durability. Another object of the present invention is to provide a sportboard fin attachment system which is easy to manufacture in a cost efficient manner.

As used herein, the term "sportboard" is intended to mean all types of boards used in water such as surfboards, wakeboards, sailboards and body boards. The term is also intended to encompass all types of watercraft such as boats, kayaks, canoes and catamarans.

The sportboard fin mounting system of the present invention includes a fin engagement enclosure that is fitted into a sportboard recess. The enclosure has an enclosure attachment means that includes a tag slot that extends into the enclosure and longitudinally along the length of the enclosure. The tag slot merges into an orthogonal pin slot, which similarly extends longitudinally within the enclosure. The tag slot and pin slot combine to define an undercut opening for receiving a fin connector assembly.

Ideally, the fin engagement enclosure is molded as a single integral structure. However, for ease of manufacture and assembly within a sportboard, the enclosure comprises the combination of plug and socket parts. The pin slot is formed in the plug, while the tag slot is formed in the socket. The plug and socket parts are fixed together to establish the above-described overall enclosure structure.

The plug part includes a clamp portion through which extends the elongated pin slot. The pin slot is defined by flexible upper and lower clamp portions. The clamp includes friction engagement means comprising, among other things such as serrations, ribs, dimples and roughened surfaces, a plurality of upper notches in the upper clamp portion and corresponding lower notches in the lower clamp portion.

To fix a fin to a sportboard, the fin is provided with a linkage means that includes a downwardly projecting tag having an outwardly extending tag pin. When the tag is inserted into the tag slot, the tag will be simultaneously inserted into the pin slot. The upper clamp portion is urged towards the lower clamp portion by a drive means to cause one of the upper notches and one of the lower notches to engage the pin and hold the tag within the tag slot.

The drive means may comprise a cam mechanism, stem bolt and nut combination or a grub screw as shown herein.

The grub screw is threaded into a grub screw opening in the socket that is proximate the upper clamp portion when the plug is inserted into the socket. As the grub screw is turned, part of the screw passes through the grub screw opening and contacts the upper clamp portion. Further tightening of the grub screw imparts a force onto the upper clamp portion that urges the upper clamp portion towards the lower clamp portion as described above to secure the tag pin.

To adjust the longitudinal position of the fin, the grub screw is loosened until the upper and lower clamp portions move away from and disengage the tag pin. Next, the fin is moved forward or backward into any one of a number of predetermined locations defined by the respective upper and lower notches (Corresponding pin location means such as indicator fingers, may be formed in the socket to enable the user to determine which upper notch and lower notch are engaging the pin). Next, the grub screw is re-tightened as described above to engage the tag pin and fix the fin to the sportboard.

To secure the fin engagement enclosure to the sportboard, a recess is formed in the underside of the sportboard. Next, at least one transverse bore is made that extends from a side edge of the board into the sportboard core until it intersects with the recess. The enclosure is placed, in the recess so that it rests on outriggers, and resin is poured into the recess. The resin files the portion of the recess not occupied by the enclosure, as well as the transverse bore(s). When the resin hardens, the enclosure will be fixed within the board, while the hardened resin within the transverse bore will reinforce the overall assembly. After hardening, excess resin is sanded away until the outer surface of the enclosure is smooth and co-planar with the underside surface of the board.

The assembly of the present invention further includes a tilt means for angling the fin relative to the sportboard underside. This is accomplished by making the aforementioned tag detachable from a fin and the enclosure. The tag is preferably a solid polygonal structure having first and second sidewalls and opposing end walls. It has a top surface with a tag attachment means comprising a longitudinal guide channel that extends into the upper face and along at least a portion of the length of the tag. The top surface of the tag matingly engages a corresponding bottom surface of the fin base underside.

The underside of the fin base is provided with a fin connector structure comprising a longitudinal guide rail having a round cross-sectional shape that corresponds to the diameter of the guide channel. For attachment, the guide rail is inserted into the tag guide channel and is moved until the tag contacts a stop means proximate an end of the guide rail. To achieve a variety of fin roll angles, substitute tags are provided that have top surfaces that are beveled at selected angles. When the beveled top surface is engaged with the fin underside, the fin will become aligned at an angle that is complementary to the tag top surface bevel angle.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
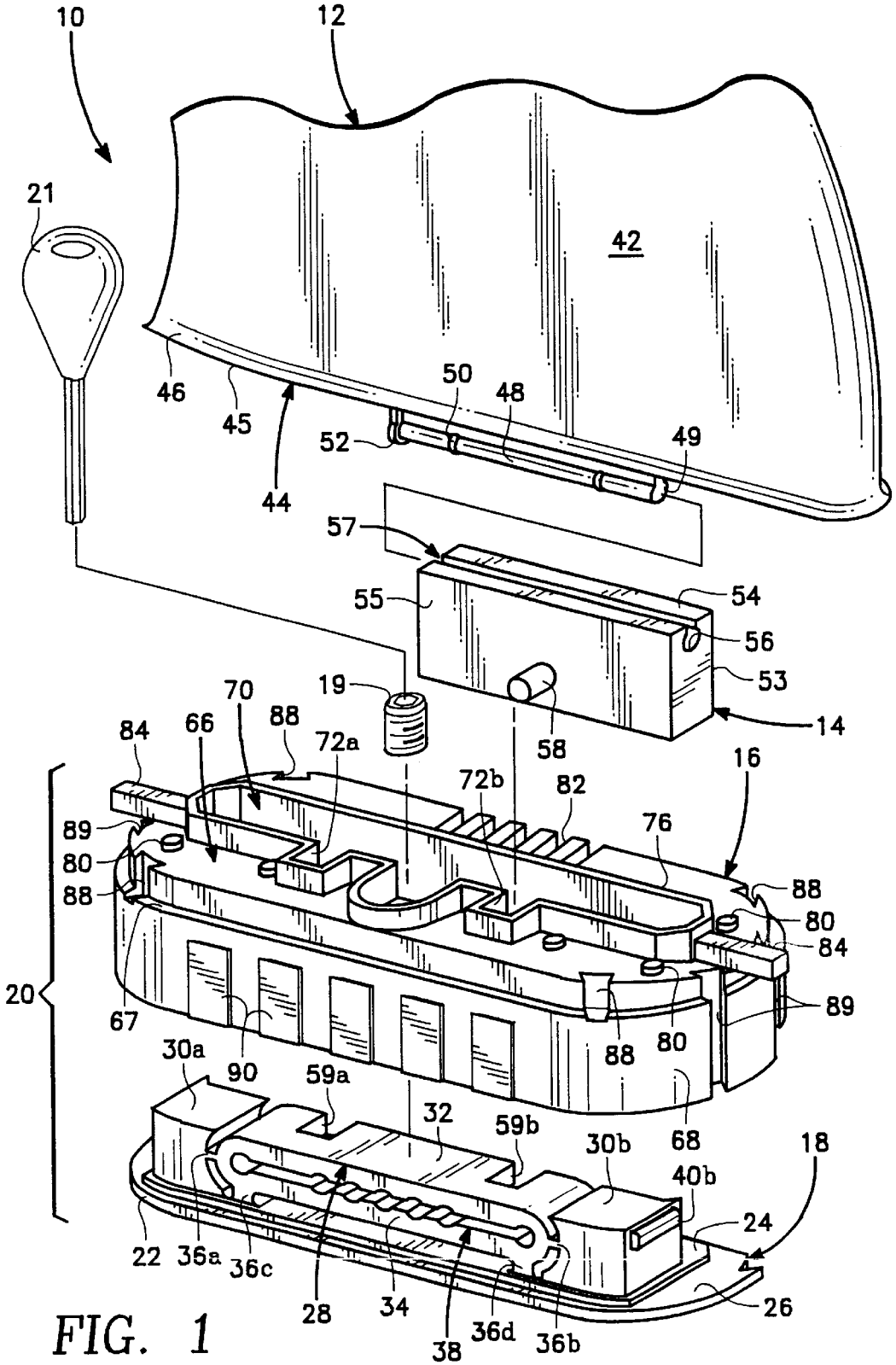
FIG. 1 is an exploded left side isometric view of the fin attachment system of the present invention.

Referring now to the Figures, the fin attachment system of the present invention is shown and is generally designated by reference character 10. As mentioned above, although the invention is described herein by reference to a surfboard, it is intended that the term "surfboard" comprehends all types of water craft and sportboards used in relation to water.

In brief overview, the system comprises a fin 12 and a linkage means that includes a downwardly projecting tag 14 that can be selectively attached/detached to the underside of the fin. The system includes a socket 16 and a plug 18 that cooperate to define fin engagement enclosure 20. The enclosure 20 is embedded into the surfboard 104 and receives the tag so that the tag and the fin (when attached to the tag) may be secured to the surfboard (See FIG. 14). A grub screw 19 and an implement shown as hex key 21 for turning the grub screw, are used to exert a force on the plug to engage the tag in a manner more fully described below.

Referring now primarily to FIG. 1, the fin comprises a dorsal section 42 that merges into fin base 44 having a generally flat underside surface 45. A fillet 46 extends around the base periphery in a somewhat bell-shaped configuration. The fillet reinforces the fin against forces normal to the dorsal section during operation of the surfboard. A flange 52 extends downwardly from the mid-portion of fin underside 45. A longitudinal rail 48 is fixed at a proximal end to the flange 52 and extends to an opposing free end 49. The rail is offset from the fin underside a distance sufficient to create a mating engagement between underside 45 and tag top surface 54. Although one flange is shown and described herein, two or more flanges or one elongated flange extending along a portion of the rail could be used to strengthen the fin-to-rail connection.

The rail is aligned with the long axis of the fin and has a length that is preferably about less than one-half the length of the fin. The rail has a circular cross-sectional so that it may rotatably and slidably engage guide channel 56 of the tag 14. The rail may include a plurality of outwardly extending spaced-apart ribs to enhance frictional engagement with the tag guide channel 56.

The aforementioned detachable tag comprises a solid block-like structure having a front side wall 55 and a back side wall 53. It includes opposing end walls that define a length that is preferably at least half the length of rail 48. The tag has a top surface 54 which is preferably flat to provide a mating engagement with a corresponding flat portion of fin underside 45.

Extending downwardly into the top surface 54 is the guide channel 56. The guide channel has a cross-section that is about equal to the rail cross-section so that snug translational movement can occur between the parts. The channel should be located below top surface 54 a predetermined distance that corresponds with the space between rail 48 and fin underside 45. In this way, a close mating engagement can occur between the aforementioned corresponding portions of the fin underside surface 45 and tag top surface 54.

Front side wall 55 of the tag has a tag pin 56 extending outwardly from the side wall lower central portion. The tag pin has a length and diameter sufficient to engage pin slot 38 in a manner to be described below.

For assembly of the tag to the fin, free end 49 of rail 48 is inserted into rear open end 57 of guide channel 56. The tag is slid along the rail until it abuts a stop means shown as flange 52. Other abutment structures could also be used such as cross-pins, pegs, ribs, rings and projections. The annular ribs 50 shown on the guide rail, enhance friction engagement between the channel and rail to thereby firmly engage the tag to the fin.

Figure 11:
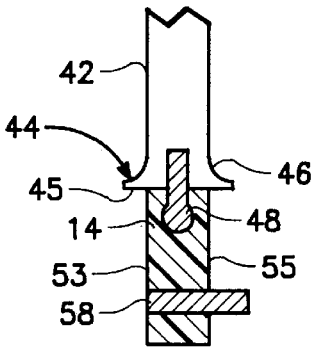
FIG. 11 is a cross-sectional schematic end view showing the perpendicular attachment of the fin to the tag.

As mentioned previously, the tag top surface 54 may be flat for a mating coplanar engagement with a similar flat surface 45 on the fin underside. Similarly, if either or both of the surfaces are beveled, the fin will assume a tilt relative to the plane of the board underside. In FIG. 11, the plane of the fin underside is perpendicular to the fin vertical axis and the plane of the tag top surface is parallel with the board underside plane. This results in the fin being aligned perpendicular to the board underside plane.

Figure 12:
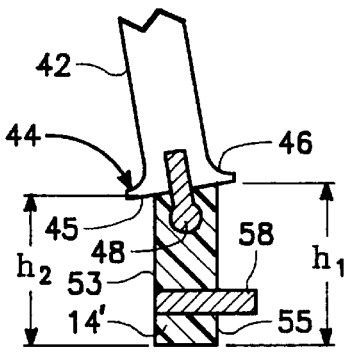
FIG. 12 is a view similar to FIG. 11 showing the tag upper surface beveled and the fin tilted at an angle complimentary to the angle of bevel.
Figure 14:
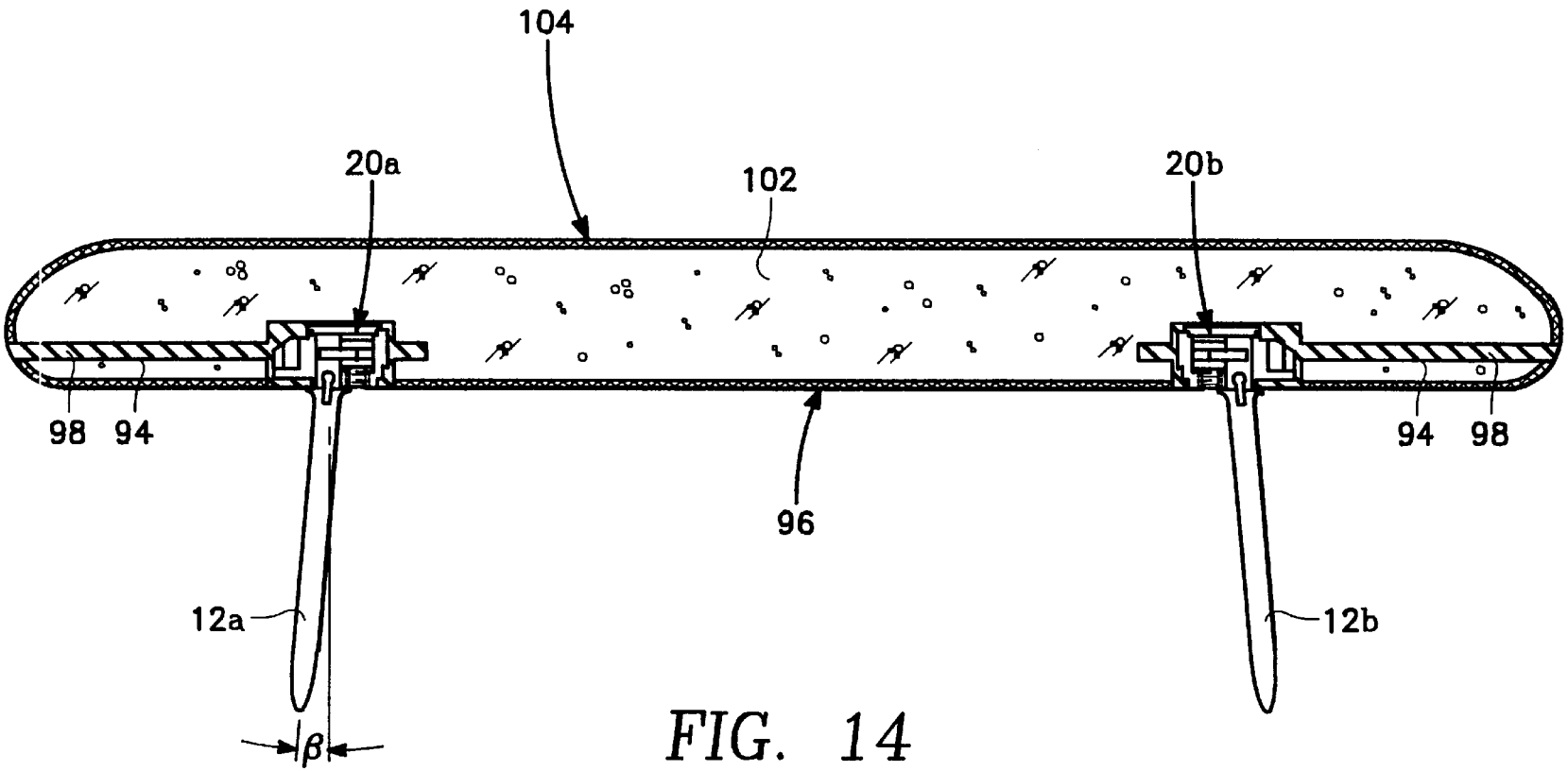
FIG. 14 is a cross-sectional view across the rear portion of a surfboard showing a pair of fins installed with the tag, socket and enclosure system of the present invention.

Alternatively, as shown in FIG. 12, the top surface of tag 14' can be beveled across its width so that the tag has a resultant continuing decrease in height from a maximum height $h_1$ on first side 55 having the tag pin, to a minimum height $h_2$ on the opposing tag back side wall 53. When the beveled tag is fastened to the fin, and the tag is then inserted into the surfboard as described below, the net effect is a fin that extends from the underside at an angle β as shown in FIG. 14. It will be appreciated that to achieve the angular position, rail 48 will rotate counterclockwise within channel 56.

Figure 13:
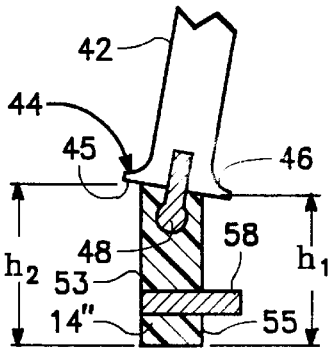
FIG. 13 is a view similar to FIG. 12 with a different tag bevel angle and fin angle.

Conversely, the tag upper surface can be inclined so that the tag has a resultant continuing increase in height from a minimum height $h_1$ on front side wall 55 to a maximum height $h_2$ on the opposing back sidewall 53 (see tag 14" in FIG. 13). This configuration yields the angled fin **12*b* shown in FIG. 14**.

Accordingly, the detachable tag subassembly affords great flexibility in the selection of angular fin placement. Stated differently, the detachable tag subassembly allows the user to choose a fin roll angle to maximize surfboard performance according to the desires of the user. It should also be appreciated that the angles from vertical that are established by the fin-tag combinations shown in FIGS. 11–13, are not intended to be limiting and a much wider range of angles β is envisioned by the present invention.

The enclosure 20 comprises the combination of a plug structure 18 and a peripheral socket 16. The plug includes a plate-like base 22 having a defined base outline. Resting upon the base is an upraised base portion 24 having an inset periphery that is spaced inwardly from the base outline. The area between the inset periphery and base outline defines a shoulder 26.

A clamp 28 extends upwardly from the upraised base portion. As shown, the clamp is an elongated solid structure that has been configured to provide an adjustable clamp means for tag 14. It comprises opposing end portions **30*a*, 30*b*, having ridge parts 40*a*, 40*b* extending outwardly from respective outer faces of each end portion. The ridges frictionally engage the interior socket cavity 41 of socket 16 (shown in FIG. 3**) when the plug is inserted into the cavity as described below.

Clamp 28 further includes an upper clamp portion 32 and a lower clamp portion 34 that are located between the end portions **30*a*, 30*b* and connected to the end portions with respective trusses 36*a*, 36*b*. The upper clamp portion 32 and lower clamp portion 34 define a pin slot 38 for receiving the aforementioned tag pin 58. The interior surfaces of the pin slot are provided with friction engagement means shown as a plurality of corresponding spaced-apart upper notches 60 and lower notches 62. The notches comprise arcuate indentations sized to engage outer surface portions of tag pin 58**.

Spaced-apart pin channels **59*a*, 59*b* are formed in the upper clamp portion proximate the opposing ends of the pin slot 38**. The pin channels intersect the pin slot to allow for passage of the tag pin through the upper clamp portion into the pin slot. Once in the slot, the pin can be moved laterally and become engaged with a corresponding upper notch and lower notch.

Trusses **36*c*, 36*d* support respective opposing ends of the lower clamp portion 34 in a spaced-apart relationship with the upraised base portion 24. The open space created thereby defines a compensation slot 64 between the lower clamp portion and the upraised base portion 24. The compensation slot accounts for any oversanding during installation of the enclosure to the sportboard by allowing the lower clamp portion (in addition to the upper clamp portion) to flex as described below. This will insure that the lower clamp portion and upper clamp portion will always be able to securely grip tag pin 58** during operation of the assembly.

Socket 16 is an oblong peripheral structure having an open bottom from which extends a socket cavity 41. The cavity is defined by a surrounding side wall 68 and the cavity interior is sized to receive the plug structure 18.

Overlying the cavity is top wall 66. Access through the top wall to the cavity is provided by tag slot 70. The tag slot is elongated and configured to permit passage of tag 14 and includes spaced-apart cut-out areas **72*a*, 72*b*. Each cut-out area is aligned with a respective pin channel 59*a*, 59*b* so that tag pin 58 will pass freely into pin slot 38** of the plug.

A threaded grub screw opening 74 is formed in the top wall 66 adjacent tag slot 70 and between the cut-out areas **72*a*, 72*b*, at approximately the mid-portion of the socket. A temporary resin barrier wall 76** extends upwardly from the top wall and follows periphery of the tag slot, the cut-out areas and the grub screw opening. The resin barrier prevents entry of resin into the cavity during installation of the assembly.

Figure 6:
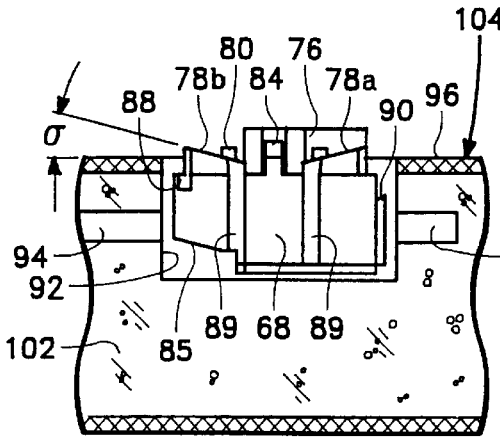
FIG. 6 is a fragmentary cross-sectional view taken along lines 6—6 of FIG. 4.
Figure 7:
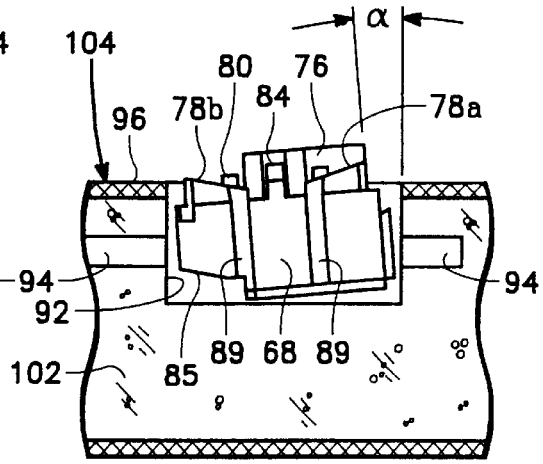
FIG. 7 is a view similar to FIG. 6 with the enclosure canted to illustrate an alternate installation embodiment of the enclosure within the surfboard.
Figure 8:
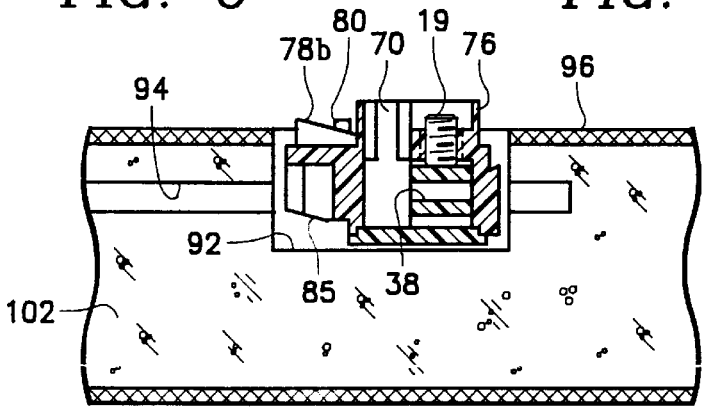
FIG. 8 is a fragmentary cross-sectional view taken along lines 8—8 of FIG. 4.

The top wall includes a multiplicity of features which facilitate installation of the assembly within a sportboard and operation of the system after installation. Specifically, and referring now primarily to FIGS. 6–8, top wall 66 may be formed with opposing bilateral beveled surfaces 78*a*, 78*b*. The beveled surfaces incline upward from the centerline of the socket to side wall 68 so that they form an angle σ with a horizontal plane when the enclosure (and socket) are oriented horizontally, as can be seen in FIG. 6. The inclined surfaces 78*a*, 78*b* allow the socket to be canted during installation (See FIG. 7), yet still have one inclined surface that is co-planar with the surfboard underside 96 after assembly. This provides the user with additional installation options if a more extreme fin roll angle is desired.

To further facilitate installation, a plurality of spaced-apart indicator pegs 80 extend upwardly from the beveled surfaces. The pegs provide an installer with a visual indication of when an appropriate amount of excess resin has been removed during installation of the device to a surfboard. Temporary outriggers shown as shafts 84, 84, are fixed to each opposing end of top wall 66 of the socket. The outriggers are aligned with the longitudinal centerline of the socket and extend longitudinally outward past side wall 68.

Figure 2:
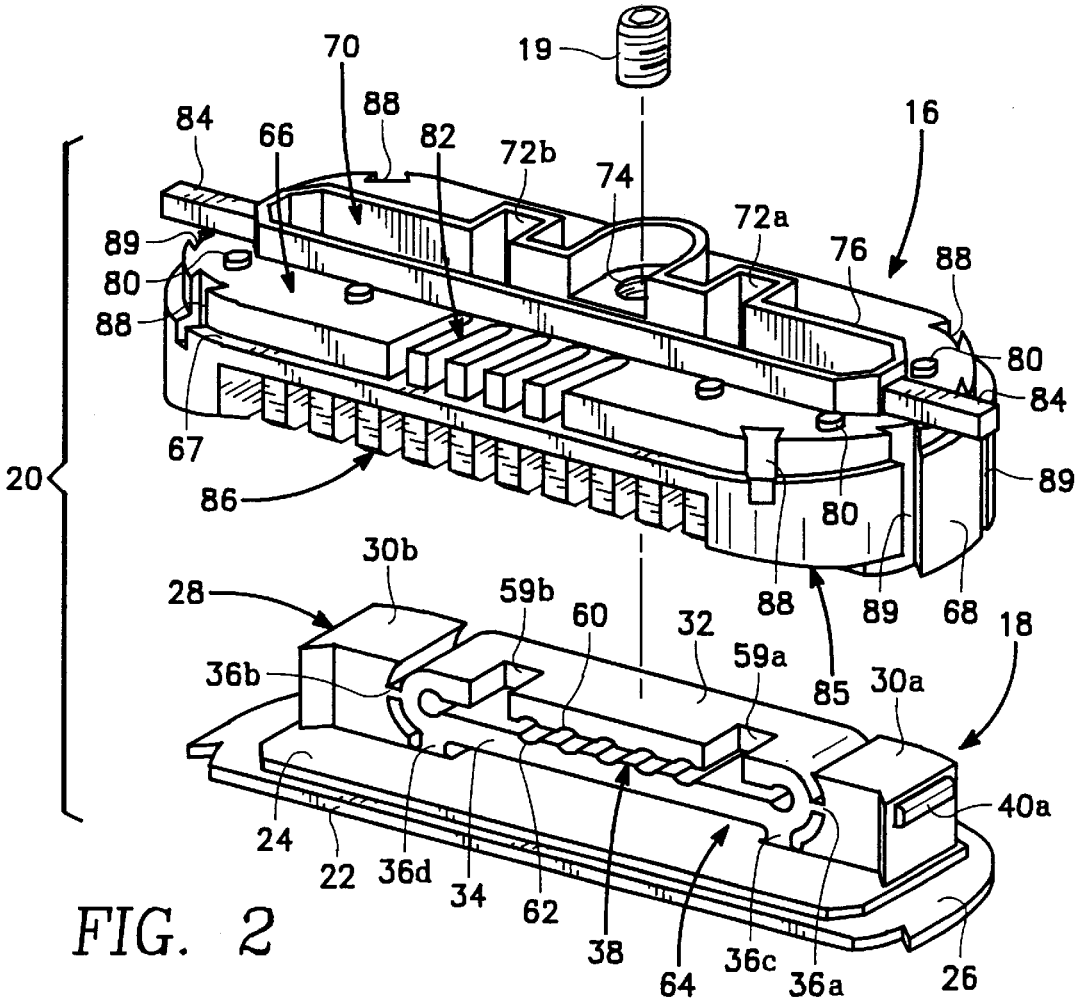
FIG. 2 is an exploded right side isometric view of the fin engagement enclosure of FIG. 1.
Figure 3:
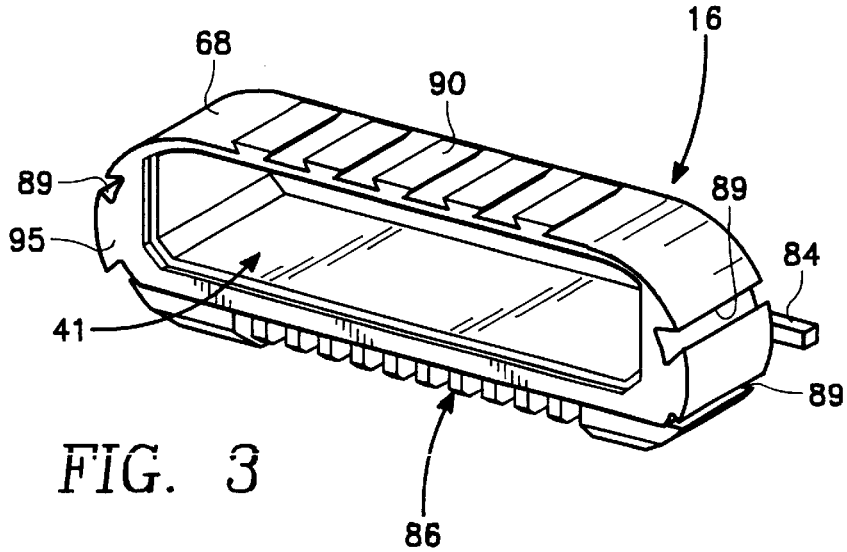
FIG. 3 is an isometric view of the underside interior of the socket of the enclosure shown in FIG. 1.

As shown in FIGS. 2 and 3, a plurality of adhesion grooves 86 are formed in the lower recessed portion of side wall 68. The adhesion grooves provide an increased overall surface area for bonding the socket to recess 92 with resin during installation of the enclosure. Similarly, a plurality of spaced-apart short and long socket notches 88 and 89 extend vertically at locations proximate end portions of the side wall. The socket notches provide increased surface areas for resin adhesion during assembly.

As best seen in FIGS. 1 and 2, the top wall 66 also includes a plurality of horizontal spaced-apart location fingers 82 that are located opposite the tag slot 70 from grub screw opening 74. The fingers have a color that contrasts with the surrounding resin. They are positioned above a respective upper notch and lower notch in the socket clamp 28 and allow the user to determine the location of pin 58 within the pin slot 38. When fin 12 is attached to the installed enclosure, the fingers will also provide the user with an indication of the location of the tag (and fin) relative to the enclosure. As such, the fingers 82 provide a visual indicator for a series of fin positions which are selectable by a user.

The side wall 68 of the socket also includes one or more undercut anchor ribs 90. The anchor ribs extend vertically from socket base 95 to an upper portion of top wall offset lip region 67. The ribs provide a visual indicator of resin level in recess 92. They also function to help secure the enclosure 20 to surfboard core 102.

Installation

Figure 4:
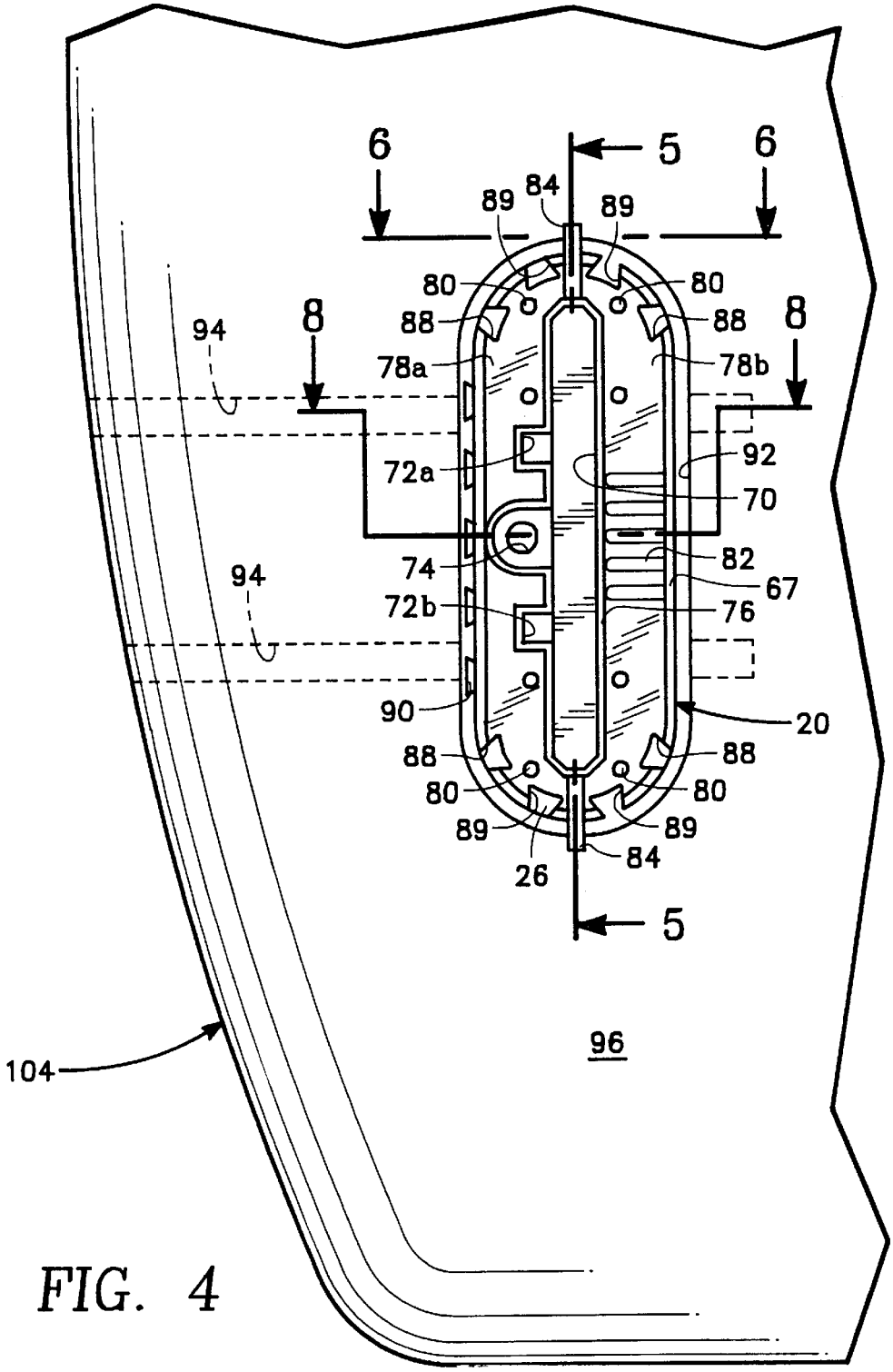
FIG. 4 is a top plan view of the enclosure shown in FIG. 1, fitted within a surfboard recess with surfboard transverse bores shown in phantom.
Figure 5:
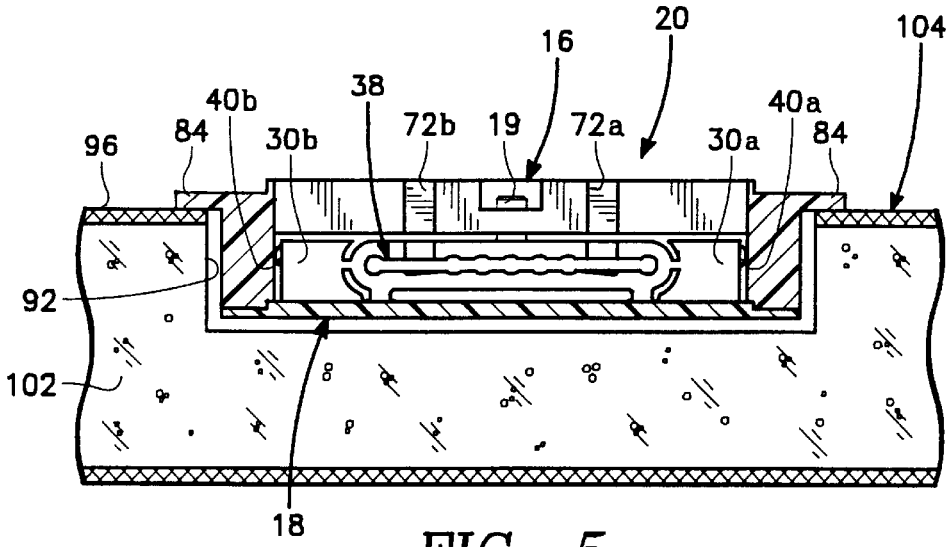
FIG. 5 is a fragmentary cross-sectional view taken along lines 5—5 of FIG. 4.

Prior to installing enclosure 20 to the surfboard 104, recess 92 is formed in the underside 96 of the surfboard. The outline of the recess corresponds closely to the top plan profile of the enclosure (less the outriggers). At least one, and preferably two or more, transverse bores 94 are formed in the surfboard core 102. The transverse bores extend from a side edge of the board through the surfboard core into the surfboard recess 92. The bores preferably extend past the recess a short distance toward the centerline of the board as shown in the FIG. 4. When filled with cured resin, the transverse bores provide reinforcement for the enclosure and prevent dislodging of the enclosure after installation. It is to be appreciated, however, that installation of the enclosure could be accomplished without the resin-filled bores. Also, other transverse support members could be used such as wood, plastic or light alloy stringers.

For assembly of the enclosure, socket 16 is snap-fit onto plug 18 by urging the plug structure into socket cavity 41 until base shoulder 26 on the plug contacts socket bottom 95. Simultaneously, ridges 40*a*, 40*b* become frictionally engaged to the interior of the socket cavity to thereby fix the plug within the cavity.

After the plug and socket have been assembled to form the enclosure 20, the enclosure is placed within the surfboard recess 92. The surfboard recess must have sufficient depth so that when this is accomplished, the outriggers will rest on the underside of the board and the enclosure will be suspended and spaced-apart from the bottom and sides of recess 92. This is best seen in FIGS. 5–8. Optionally, as noted above and shown in FIG. 7, the enclosure can be placed in the surfboard recess and canted at an angle σ.

With the enclosure positioned as desired, resin 98 is poured around the enclosure so that it fills the transverse bores, all notches, grooves and the portion of the surfboard recess not occupied by the enclosure. Thereafter, the resin is allowed to cure for a predetermined time as is known in the art. The resin and socket may have different, contrasting colors to facilitate the sand-off process and to enhance visibility of fingers 82 during fin installation and adjustment.

Figure 9:
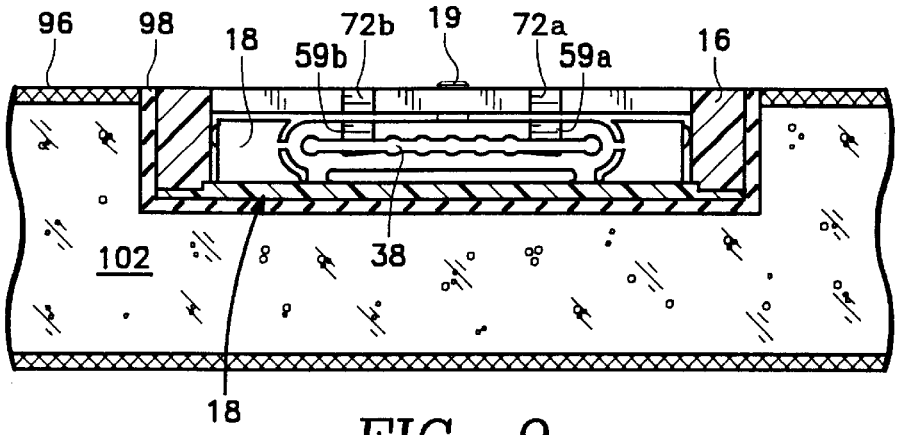
FIG. 9 is a view similar to FIG. 5, with the surfboard recess filled with resin and the resin barrier and indicator pegs sanded down after installation so that the enclosure outer surfaces are co-planar with the surfboard underside.
Figure 10:
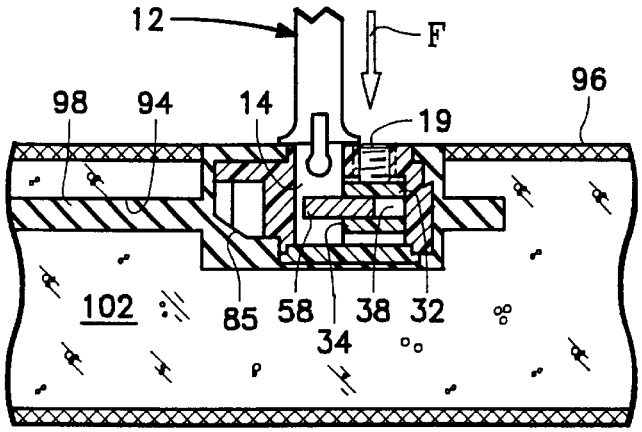
FIG. 10 is a view similar to FIG. 8, with the surfboard recess filled with resin and further illustrating the manner in which the surfboard tag and pin cooperate with the enclosure.

After the resin has cured, the underside of the board is sanded until all excess resin is removed and the surface of top wall 66 is co-planar with a plane defined by the underside surface 96 of the board. During this process, the resin barrier 76, outriggers 84 and indicator pegs 80 became removed from the enclosure. This is best seen in FIGS. 9, 10 and 14. Preferably, indicator pegs 80 are also formed with a color that contrasts with the resin so that it is easy to determine when sanding is complete. Otherwise, it is possible to oversand the board and form an unwanted depression in the underside of the board. Once the board has been sanded, the surfboard (with the embedded enclosure) is ready for operation.

Operation

A user will consider ambient conditions and choose the desired fin roll angle. He/she then selects a tag that is beveled in correspondence to the desired fin roll angle. The selected tag is then connected to fin 12 by sliding the longitudinal guide channel 56 onto rail 48, until rear open-end 57 of the channel contacts flange 52.

After the tag is connected to the fin, the user aligns the tag above tag slot 72. At this time, the tag pin 58 may be aligned with either of cut-out areas 72*a* or 72*b*. (Cut-out area 72*a* is chosen for convention). The tag is now moved into the tag slot whereby the tag pin will pass through cut-out area 72*a*, through pin channel 59*a* and into pin slot 38. When pin 58 is in a pin slot 38, a user may move the fin (and tag) longitudinally forward and/or back to one of several predetermined positions displayed by fingers 82. As mentioned, each finger corresponds to a respective upper notch 60 and lower notch 62 in the pin slot. Once the fin is in the desired longitudinal position, grub screw 19 is placed into threaded grub screw opening 74 and the screw is rotated with implement 21 until it contacts upper clamp portion 32. Further tightening of the grub screw will transmit a force (shown as force F in FIG. 10) onto the upper clamp portion. This action will flex the upper clamp portion toward the lower clamp portion to thereby frictionally secure the tag pin in the pin slot.

If the board has been oversanded, the lower clamp portion 34 will also flex into compensation slot 64 until it abuts against upraised plug base portion 24. This will provide a counterforce and insure a strong securement of the tag pin 58 to the pin slot 38.

If the user wishes to change the position of the fin, the grub screw is loosened until the upper clamp portion 32 and lower clamp portion 34 are disengaged from the tag pin. Then, the fin may be moved forward or backward until it is located in a new desired position. Thereafter, grub screw is re-tightened to cause the sequence of actions described above. For removal, the grub screw is loosened and pin 58 is moved longitudinally until it is aligned with pin channel 59*a* and cut-out area 72*a*. The fin may then be pulled outward to remove the tag from the tag slot.

While the particular surfboard fin attachment assembly shown and disclosed herein is fully capable of obtaining the objects and providing the advantages above stated, it is to be understood that the presently preferred embodiments are merely illustrative of the invention. As such, no limitations are intended other than as defined in the appended claims.

I claim:

1. A fin for attachment to a sportboard comprising:

a fin body having an underside and a fin longitudinal axis; and, a linkage means connected to said fin body, adjacent said underside, said linkage means having a longitudinal axis that is about parallel to said fin longitudinal axis, wherein said linkage means comprises at least one flange extending downwardly from said underside which is connected to at least one rail, said rail extending from said flange to a terminal free end.

2. The fin of claim 1 including at least one tag attached to said linkage means.

3. The fin of claim 2 wherein said tag has a top surface that is engagable with a corresponding surface of said fin underside.

4. The fin of claim 2 wherein said fin underside defines a plane and said top surface is beveled relative to said plane.

5. The fin of claim 2 wherein said sportboard has at least one enclosure with an enclosure attachment means for connecting said tag to said enclosure.

6. The fin of claim 5 wherein said tag has at least one pin and said enclosure attachment means comprises at least one clamp having an elongated slot into which said pin extends.

7. The fin of claim 6 wherein said slot includes friction engagement means for securing said pin at predetermined positions within said slot.

8. The fin of claim 7 wherein said enclosure includes observable pin location means for indicating the position of said pin in said slot.

9. An enclosure for connecting a fin to a sportboard comprising:

a socket having a sidewall that defines a cavity and a top wall that overlies said cavity;

a tag slot extending through said top wall; and, a plug extending into said cavity having a base from which extends a clamp, said clamp having a pin slot that is accessible through said tag slot.

10. The enclosure of claim 9 including a drive means attached to said socket for imparting a force to said clamp.

11. In a fin that is connected to a tag which is releasably secured to a sportboard enclosure wherein the improvement comprises:

a fin having a tag connector structure, said tag having attachment means for engaging said tag connector structure; and, said tag having an enclosure attachment means for connecting said tag to said enclosure, wherein said sportboard has an underside and said tag includes a tilt means for orienting said fin at an angle relative to said underside.

12. The fin of claim 11 wherein said fin has a bottom surface and said tag has a top surface, said tilt means comprising a bevel in either one or both of said bottom surface and top surface.

13. The fin of claim 11 wherein said enclosure has a pivot slot and said enclosure attachment means comprises at least one tag pin that extends into said pivot slot.

14. The fin of claim 13 wherein said pivot slot is elongated and includes friction engagement means for securing said tag pin at selected positions within said slot.

15. The fin of claim 14 wherein said pivot slot has interior surfaces and said friction engagement means comprises notches in said interior surfaces at spaced-apart predetermined positions.

16. The fin of claim 14 wherein said pivot slot comprises a flexible upper clamp portion and a lower clamp portion, said enclosure having a drive means for flexing said upper clamp portion toward said lower clamp portion.

17. An assembly for mounting a fin to a sportboard, said fin having a fin base comprising:

at least one tag connected to said fin base;

at least one tag pin extending from said tag;

at least one socket fixed to said sportboard, said socket having a cavity and a top wall;

at least one tag slot extending through said top wall into communication with said cavity;

a plug extending into said socket cavity, said plug having at least one pin slot in communication with said tag slot; and, said tag being positioned in said socket cavity so that said tag pin extends into said pin slot.

18. The assembly of claim 17 wherein said sportboard has an underside within which extends a recess, said socket and plug being secured to said sportboard within said recess.

19. The assembly of claim 18 wherein said sportboard has a core and a side edge, said sportboard including at least one transverse bore extending from said side edge through said core and into said recess.

20. The assembly of claims 17 wherein said top wall includes a plurality of upstanding indicator pegs.

21. The assembly of claims 17 wherein said pin slot is defined by a flexible upper clamp portion and a lower clamp portion, said socket including a drive means for imparting a force to flex at least said upper clamp portion.

22. The assembly of claim 21 wherein said pin slot includes a frictional engagement means for releasably securing said tag pin between said upper clamp portion and lower clamp portion.

23. The assembly of claim 22 wherein said pin slot has interior surfaces and said frictional engagement means is formed on said interior surfaces and comprises a member selected from the group consisting of notches, serrations, ribs, dimples, projections and roughened surfaces.

24. The assembly of claim 23 wherein said frictional engagement means provides predetermined tag pin positions and said top wall includes a plurality of finger locator members which are individually positioned above respective predetermined tag pin positions.

25. The assembly of claim 17 wherein said fin includes at least one fin connector means for releasably connecting said tag to said fin base.

26. The assembly of claim 25 wherein said fin connector means includes at least one flange that interconnects said fin base with at least one rail.

27. The assembly of claim 26 wherein said tag has a top surface into which extends at least one channel, said rail being slidable into said channel.

28. The assembly of claim 27 wherein said sportboard has an underside that defines a bottom plane and said top surface is inclined relative to said bottom plane.

29. A sportboard having an underside with at least one fin comprising:

at least one recess in said underside;

at least one enclosure fixed to said sportboard in said recess, said enclosure having at least one cavity;

at least one transversely extending pin slot in said enclosure in communication with said cavity;

a fin with a base from which extends at least one tag having at least one transversely extending tag pin, said tag being positioned in said cavity and said tag pin extending into said pin slot, wherein said pin slot includes friction engagement means for releasably securing said tag pin in said pin slot.

30. The sportboard of claim 29 wherein said pin slot is defined by flexible clamp portions and said enclosure includes a drive means for imparting a force against said clamp portions.

31. The sportboard of claim 29 wherein said tag is releasably connected to said fin base with a linkage means.

32. The sportboard of claim 31 wherein said linkage means includes at least one rail that is fixed to said base and said tag includes at least one channel into which said rail extends.

33. The sportboard of claim 32 wherein said sportboard has an underside that defines a bottom plane and said tag has a top surface that is inclined relative to said bottom plane.

34. A method for attaching a fin to a sportboard having an underside comprising the steps of:

(A) providing an enclosure having a cavity, a clamp in said cavity having a pin slot in communication with said cavity;

(B) forming a recess in the said underside;

(C) securing said enclosure within said recess by establishing at least one bore in said surfboard in fluid communication with said recess, flowing a resin compound into said bore and into recess spaces surrounding said enclosure, and allowing said resin to harden, wherein said enclosure has a top wall from which extends a plurality of indicator pegs and a resin barrier, including the steps of removing said indicator pegs and said resin barrier until said tip wall is about co-planar with said underside;

(D) providing a tag having an outwardly extending tag pin;

(E) attaching said tag to said fin;

(F) inserting said tag into said cavity so that said tag pin will extend into said pin slot;

(G) exerting a force against said clamp to fix said tag pin in said pin slot.

35. The method or claim 34 wherein said fin has a rail and said tag has a channel, wherein step (D) further includes the step of (H) inserting said guide rail into said guide channel.

* * * * *